United States Patent [19]

Stockdale

[11] Patent Number: 4,474,375

[45] Date of Patent: Oct. 2, 1984

[54] TABLETOP HOCKEY GAME

[76] Inventor: Gordon Stockdale, 332 The Heights Dr., Don Mills, Ontario, Canada, M3C 1Y3

[21] Appl. No.: 204,565

[22] Filed: Nov. 6, 1980

[51] Int. Cl.[3] ..... A63F 7/06

[52] U.S. Cl. ..... 273/85 B; 273/85 F

[58] Field of Search ..... 273/85

[56] References Cited

U.S. PATENT DOCUMENTS

| | | | |
|---|---|---|---|
| 2,507,258 | 5/1950 | Kohler | 273/85 B |
| 3,647,212 | 3/1972 | Barlow et al. | 273/85 B |
| 3,912,269 | 10/1975 | Barlow | 273/85 F X |

FOREIGN PATENT DOCUMENTS

| | | | |
|---|---|---|---|
| 2032670 | 1/1972 | Fed. Rep. of Germany | 273/85 B |
| 848479 | 7/1939 | France | 273/85 B |
| 1354075 | 1/1964 | France | 273/85 B |
| 490141 | 2/1954 | Italy | 273/85 F |
| 1502243 | 2/1978 | United Kingdom | 273/85 B |

*Primary Examiner*—Paul E. Shapiro

*Attorney, Agent, or Firm*—Donald E. Hewson

[57] ABSTRACT

A tabletop hockey game comprises a planar board, a continuous raised border defining a playing surface and a plurality of slots in said board and within said playing surface.

Player pieces are carried on pegs that pass through the slots and through arms placed below the surface. The pegs carry pulleys, and belts connect the pulleys to a handle peg and pully. Thus, moving the handle along the handle slot is effective to move the players along their slots: turning the handle turns the players.

12 Claims, 6 Drawing Figures

TABLETOP HOCKEY GAME

FIELD OF THE INVENTION

This invention relates to a tabletop hockey game and the like.

BACKGROUND OF THE INVENTION

Tabletop hockey games and the like have been in existence for some time. One of the original types of tabletop hockey game comprised of a convex playing surface with stationary player pieces strategically placed on the playing surface. The player pieces were made to move in a shooting motion by the pulling of a lever which caused all of the player pieces representing one team to move at one time. The player pieces were stationary other than for the slight rotation and did not simulate moving hockey players.

The next generation of tabletop hockey games comprised of individual player pieces which were caused to move in a linear fashion as well as to rotate about its own axis which simulated the movement of a hockey player and the shooting motion. Each of the player pieces were connected to a rod which were pushed or pulled to cause the linear movement and the rods were twisted in order to cause the shooting motion of the player pieces. The action in this type of game was greatly slowed due to the fact that there were five rods which had to be manipulated individually as well as a handle for the goalie. Movement from one rod to another as well as choosing the correct rod made the game difficult to play. Further, since the player pieces were connected directly to the rods, the player pieces could not be moved around corners and behind the net.

It is therefore an object of the present invention to provide a tabletop hockey game with only three control handles for the five player pieces and one goalie piece.

It is a further object of the present invention to provide a tabletop hockey game whereby a player piece is capable of moving around corners and behind the net.

It is a further object of the present invention to provide a goalie piece with flexible legs which may extend outwardly.

SUMMARY OF THE INVENTION

According to the invention, there is provided a tabletop hockey game comprising a planar board, a continuous raised border defining a playing surface, a plurality of slots in the board and within the playing surface, means for rotating and moving a plurality of player pieces along the slots and means for rotating and moving a goalie piece.

According to another aspect of the invention, the goalie piece has means for extending its legs outwardly.

BRIEF DESCRIPTION OF THE DRAWINGS

These and other objects, advantages and features of the invention will become apparent in the following detailed description of the preferred embodiment of the invention as shown in the drawings wherein.

DETAILED DESCRIPTION OF THE PREFERRED EMBODIMENTS OF THE INVENTION

Figure 1:
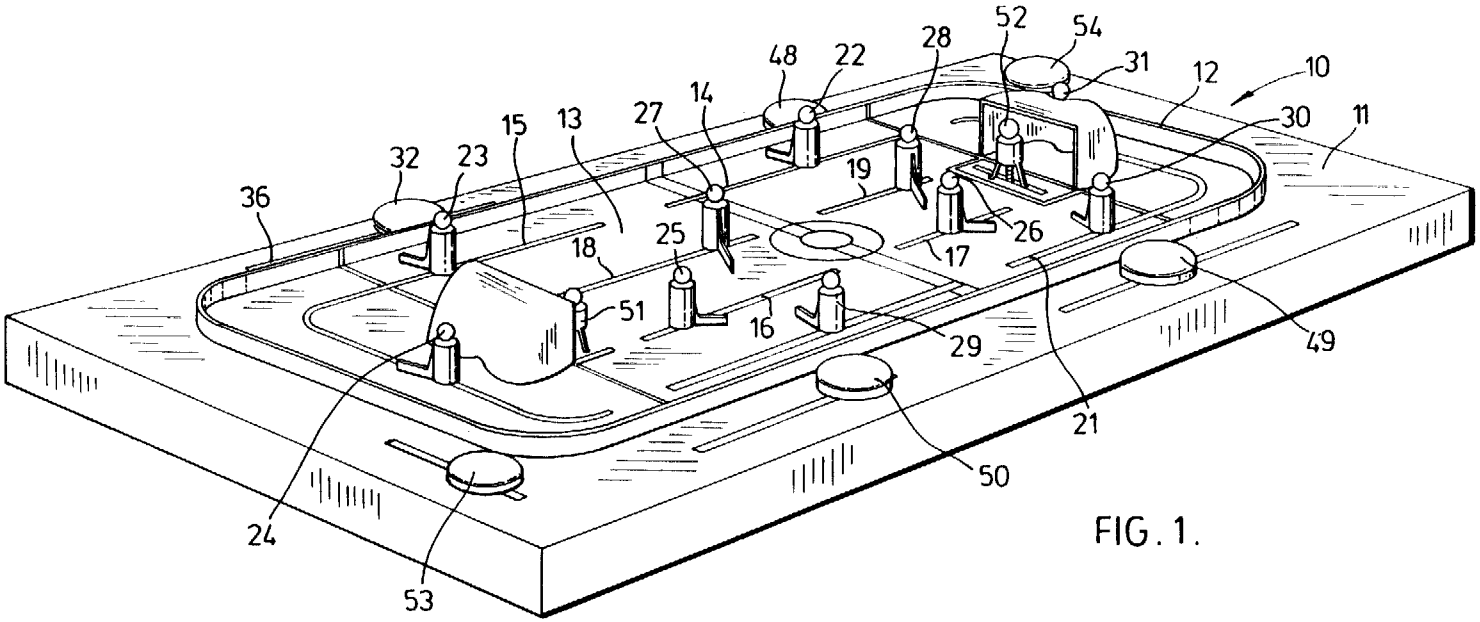
FIG. 1 is a perspective view of the tabletop hockey game.
Figure 2:
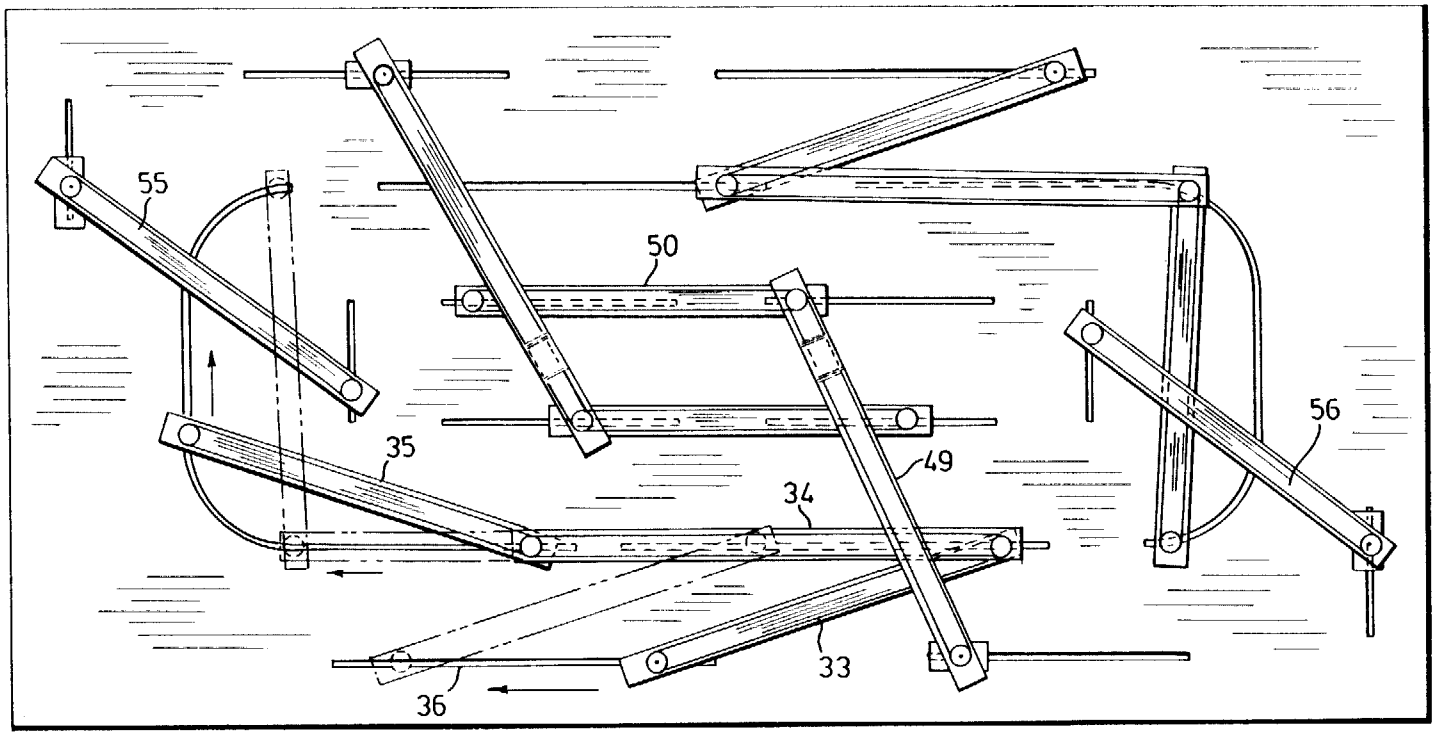
FIG. 2 is the underside view of the tabletop hockey game.

With reference to the drawings, there is shown a preferred embodiment of the invention. The tabletop hockey game designated as 10 comprises a planar board 11, a raised border 12, defining a rectangular playing surface 13 which represents the hockey playing surface, a plurality of slots 14 to 21 respectively to allow the player pieces 22 to 31 respectively to travel therealong.

Figures 3, 4:
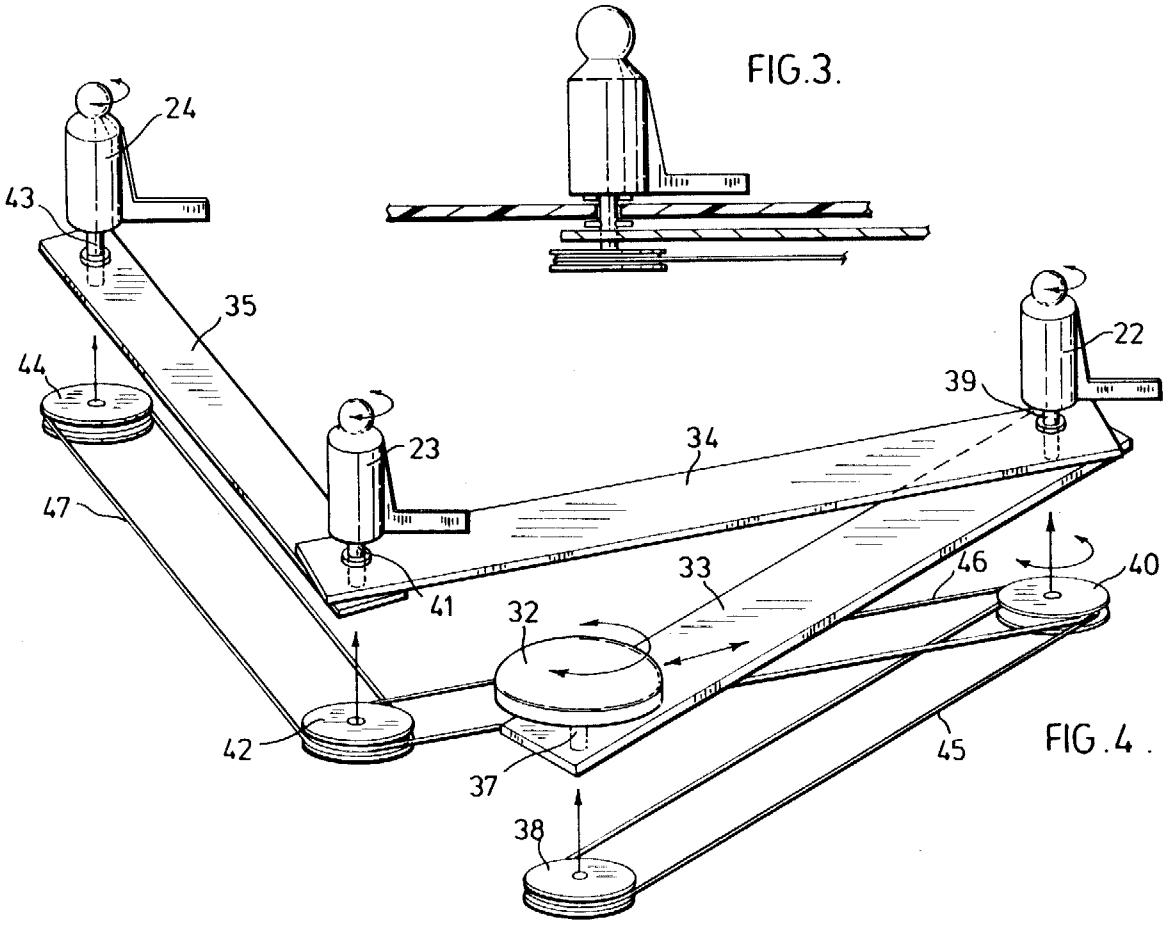
FIG. 3 is a side view of a player piece showing its relationship to the peg, board, arm and pulley.
FIG. 4 is a perspective view with portions exploded showing the arms linearly and hingedly linked with the player pieces, player control handle and the pulley and belt system.

Player control handle 32 controls player 22 to 24 respectively by means of arms 33, 34 and 35, which are linked as more clearly shown in FIG. 4. Player control handle 32 moves along slot 36 which is located outside of the playing surface.

With reference to FIG. 4, there is shown the player control handle 32, arms 33, 34 and 35. Player control handle 32 is located at one end of arm 33 and has a peg 37 which extends through the end of arm 33 and input pulley 38. Player piece 22 has peg 39 extending through the ends and hingedly joins arms 33 and 34, and has a pulley 40 secured to the end thereof. Similarly, player piece 23 has peg 41 extending through the ends of arms 34 and 35 and has pulley 42 connected to the end thereof. Player piece 24 has peg 43 extending through the end of arm 35 and has attached thereto pulley 44. Pulley 38 is connected to pulley 40 by means of belt 45 and pulley 40 is further connected to pulley 42 by means of belt 46 and pulley 42 is further connected to pulley 44 by means of the belt 47. Thus, by rotating player control handle 32, player pieces 22, 23 and 24 rotate respectively. The movement of player pieces 22, 23 and 24 along slots 14 and 15 respectively is caused by the linear movement of player handle 32 along slot 36.

Similarly, player control handle 48 controls player pieces 25 and 26 respectively by means of arms 49 and 50. The movement of player pieces 25 and 26 by means of player control handle 48 and arms 49 and 50 are similar to that described above with respect to player control handle 32 and player pieces 22 to 24 respectively.

Similarly, player control handle 49 controls player pieces 29 to 31 respectively and player control handle 50 controls player pieces 27 and 28.

The goalie pieces 51 and 52 are controlled by goalie control handles 53 and 54 respectively. Goalie control handle 53 is connected to goalie piece 51 by means of arm 55 and goalie control handle 54 is connected to goalie piece 52 by means of arm 56.

Figure 5:
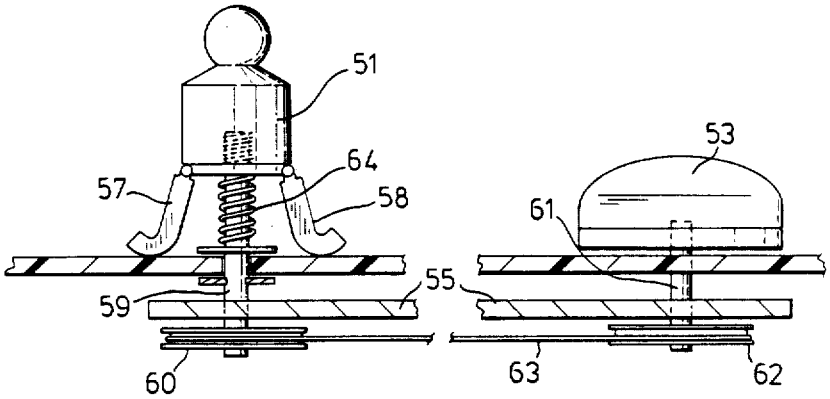
FIG. 5 is a side view of the goalie piece, goalie control handle, arm and the pulley system.
Figure 6:
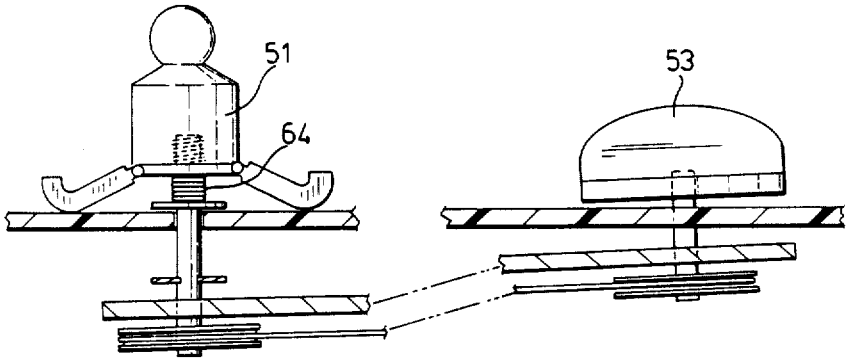
FIG. 6 is the same view as FIG. 5 with the goalie piece having its legs in the outwardly extended position.

With reference to FIGS. 5 and 6, goalie piece 51 has outwardly extendable legs 57 and 58 and a downwardly extending peg 59 which extends through one end of arm 55 and has a pulley 60 connected to the end thereof. Goalie control handle 55 has a downwardly extending peg 61 which extends through the other end of arm 55 and has pulley 62 at the end thereof. Pulleys 60 and 62 are connected by belt 63. Goalie piece 51 is caused to move in a downward motion causing legs 57 and 58 to extend outwardly by depressing control handle 53 as shown in FIG. 6. When the downward pressure on goalie control handle 53 is released, spring 64 causes the goalie piece 51 to return to its upright position.

The game may be played by a minimum of two players and a maximum of six. When the game is played by two players, one of the players would control control handles 49, 50 and 53 and the other player would control control handles 32, 48 and 54. Thus, by movement of two hands, as many as five player pieces may be moved linearly and rotated at the same time which creates a fast-moving game and simulates the game of hockey to a greater degree than other tabletop hockey games which are presently on the market.

While a specific embodiment of the invention has been illustrated and described, it is understood that variations may be made by those skilled in the art without departing from the spirit of the invention or the scope of the appended claims.

The embodiments of the invention in which an exclusive property or privilege is claimed are defined as follows:

1. Tabletop hockey game apparatus comprising a planar board having a continuous raised border defining a playing surface;

player pieces mounted on top of the playing surface, a first player piece being carried on a respective first player peg, which passes right through a first player slot which is within the playing surface;

control handles mounted on the board, a control handle being carried on a respective handle peg, which passes right through a handle slot which is outside the playing surface, and where the alignment of the handle slot is such that the line of the handle slot remains substantially always outside the playing surface;

wherein the said first player peg and the said handle peg are carried at respective pivot points on a linking arm, the points being a fixed distance apart on the arm so that the handle peg and the first player peg remain the same distance apart at all times;

wherein the first player peg and the handle peg are each pivotally mounted to the linking arm at the respective points to that each peg may rotate pivotally with respect to the arm;

wherein the handle slot and the first player slot are substantially hot in line, and a line joining the said pivot points lies at a substantial angle to the perpendicular to both slots;

wherein the arm is located as to its position and orientation with respect to the two slots by virtue only of the engagement of the two pegs each in its respective slot, and by virtue of the pegs being held a fixed distance apart in the arm, the position and orientation of the arm being otherwise not constrained with respect to the slots at all;

and wherein rotation transmitting means are provided whereby when the handle is rotated its rotary movement is transmitted in strict unison to the first player piece.

2. Apparatus of claim 1 wherein the handle is mounted on top of the board, the handle peg and the first player peg being parallel to each other and perpendicular to the player surface.

3. Apparatus of claim 2, where the rotation transmitting means comprises respective pulleys fixed one each to the handle peg and the first player peg, and a first belt connected between the two pulleys and adjusted so that rotary movenent of the handle is accompanied by a corresponding rotary movement of the player piece.

4. Apparatus of claim 3, wherein the two pulleys are the same diameter so that the handle and the first player piece rotate at the same speed.

5. Apparatus of claim 1 wherein a second player piece is carried on a respective second player peg, which passes right through a second player slot and is parallel to the first player peg;

wherein the first player peg and the second player peg are carried at respective pivot points on a second linking arm, the points being a fixed distance apart on the arm so that the two pegs remain the same distance apart at all times;

wherein the first player peg and the second player peg are each pivotally mounted to the second linking arm at the respective points so that each peg may rotate pivotally with respect to the arm;

wherein the second arm is located as to its position and orientation with respect to the first player slot and the second player slot by virtue only of the engagement of the player pegs in the player slots, and by virtue of the pegs being held a fixed distance apart in the second arm, the position and orientation of the second arm being otherwise not constrained with respect to the slots at all;

and wherein second rotation transmitting means are provided whereby when the first player piece is rotated, its rotary movement is transmitted in strict unison to the second player piece.

6. Apparatus of claim 5, wherein the handle is mounted on top of the board, the handle peg and the two player pegs being parallel to each other and perpendicular to the playing surface.

7. Apparatus of claim 6, wherein the rotation transmitting means comprises respective pulleys fixed one each to the handle peg, the first player peg, and to second player peg, and comprises first and second belts, the first belt connected between the handle pulley and the first player pulley, the second belt connected between the first player pulley and the second player pulley, the two belts being adjusted so that rotary movement of the handle is accompanied by corresponding rotary movement of the first and second player pieces.

8. Apparatus of claim 5, wherein a third player piece is carried on a respective third player peg, which passes right through a third player slot and is parallel to the first and second layer pegs;

wherein the second player peg and the third player peg are carried at respective pivot points on a third linking arm, the points being a fixed distance apart on the arm so that the two pegs remain the same distance apart at all times;

wherein the second player peg and the third player peg are each pivotally mounted to the third linking arm at the respective points so that each peg may rotate pivotally with respect to the arm;

wherein the third arm is located as to its position and orientation with respect to the second player slot and the third player slot by virtue only of the engagement of the player pegs in the player slots and by virtue of the pegs being held a fixed distance apart in the third arm, the position and orientation of the third arm being othewise not constrained with respect to the slots at all;

and wherein third rotation transmitting means are provided whereby when the second player piece is rotated, its rotary movement is transmitted in strict unison to the third player piece.

9. Apparatus of claim 8, wherein one of the player slots extends around the back of the goals.

10. Apparatus of claim 9, wherein the handle slot is aligned longitudinally with respect to the playing surface and positioned at the side of the playing surface;

wherein the first player slot is parallel to, and spaced from the handle slot;

wherein the second player slot is substantially in line with the first player slot;

and wherein the third player slot is the one that extends around the back of the goals.

11. Apparatus of claim 10, wherein the apparatus further includes a goalie piece which is operated by a goalie handle, and a further two player pieces, both operated in unison by a further handle, wherein all the handles are movable in slots, the lines of which remain substantially always outside the playing surface.

12. Apparatus of claim 11, wherein the goalie handle is rockable, and when rocked is effective to cause the goalie peg to move downwards in its slot;

wherein the goalie piece is urged upwards from the playing surface by a spring;

wherein the goalie piece includes a leg which normally lies close to the piece, but when the piece moves downwards against the spring the leg engages the playing surface and is deflected sideways thereby.

* * * * *